US005129812A

United States Patent [19]

Hodan

[11] Patent Number: 5,129,812

[45] Date of Patent: Jul. 14, 1992

[54] MULTIPLE PROFILE FILAMENTS FROM A SINGLE COUNTERBORE

[75] Inventor: John A. Hodan, Arden, N.C.

[73] Assignee: BASF Corporation, Parsippany, N.J.

[21] Appl. No.: 678,552

[22] Filed: Mar. 28, 1991

[51] Int. Cl.[5] ..... B29C 47/12

[52] U.S. Cl. ..... 425/464; 264/177.13; 425/382.20

[58] Field of Search ..... 264/177.1, 177.13, 177.14, 264/177.15; 425/461, 463, 464, 382.2

[56] References Cited

U.S. PATENT DOCUMENTS

| | | | |
|---|---|---|---|
| 2,838,364 | 6/1958 | Smith | 264/177.13 |
| 3,405,424 | 10/1968 | Imobersteg et al. | 425/464 |
| 3,493,459 | 2/1970 | McIntosh et al. | 425/464 |
| 3,652,753 | 3/1972 | Shemdin | 264/177.13 |
| 3,734,993 | 5/1973 | Paliyenko et al. | 264/177.13 |
| 3,745,061 | 7/1973 | Champaneria et al. | 428/398 |
| 3,860,679 | 1/1975 | Shemdin | 264/40.1 |
| 3,924,988 | 12/1975 | Hodge | 425/461 |
| 3,981,948 | 9/1976 | Phillips | 264/40.7 |
| 4,142,850 | 3/1979 | Phillips | 425/461 |
| 4,318,680 | 3/1982 | Pfeiffer et al. | 425/382.2 |
| 4,325,765 | 4/1982 | Yu et al. | 156/167 |
| 4,385,886 | 5/1983 | Samuelson | 425/464 |
| 4,407,889 | 10/1983 | Gintis et al. | 428/398 |
| 4,648,830 | 3/1987 | Peterson et al. | 425/464 |
| 4,836,763 | 6/1989 | Broaddus | 264/177.14 |
| 4,850,847 | 7/1989 | Samuelson | 264/177.14 |
| 4,941,812 | 7/1990 | Samelson | 264/177.14 |

FOREIGN PATENT DOCUMENTS

| | | | |
|---|---|---|---|
| 201812 | 11/1986 | European Pat. Off. | 264/177.13 |
| 269130 | 4/1934 | Italy | 264/177.13 |
| 44-899 | 1/1969 | Japan | 264/177.14 |
| 47-23972 | 7/1972 | Japan | 264/177.14 |
| 1160263 | 8/1969 | United Kingdom | 264/177.14 |

*Primary Examiner*—Jay H. Woo
*Assistant Examiner*—James P. Mackey

[57] ABSTRACT

A spinneret plate defines at least one counterbore, and within the counterbore, at least one non-round curved capillary. The capillary has a plurality of extending tips, wherein for any one capillary, at least two of the extending tips have a different radius of curvature.

13 Claims, 2 Drawing Sheets

MULTIPLE PROFILE FILAMENTS FROM A SINGLE COUNTERBORE

FIELD OF THE INVENTION

This invention relates generally to the melt spinning of filaments from molten polymers. More specifically, the invention relates to the production of profiled filaments from a single counterbore where the counterbore includes a plurality of separate non-round capillaries.

BACKGROUND OF THE INVENTION

In the melt spinning of molten polymers to produce filaments increased efficiency is nearly always a worthwhile goal. One manner of increasing the efficiency of a melt spinning process is to increase the number of fibers which can be produced during a given time from a single piece of melt spinning machinery. In furtherance of this goal, spinneret plates providing for an increased number of filaments to be extruded therethrough is of value.

Another consideration in melt spinning operations is the cross section of the extruded filament. Fibers having novel cross sections may be useful for a variety of different purposes, some of which purposes are readily apparent from the unique cross section and others which remain to be discovered. Fibers of new deniers are also invaluable. Furthermore, new combinations of deniers and cross-sections can result in commercially interesting fibers.

For the present purposes, the term "counterbore" refers to the upstream bore in a spinneret plate and its upstream orifice. The term "capillary" refers to the downstream orifice in a spinneret plate and its downstream orifice.

The following patents exemplify efforts to modify the melt spinning process and the characteristics of the resulting melt spun filament. In general, the characteristics of only a few classes of spinneret capillaries have been determined with respect to kneeing and for only a few general classes of capillary shapes. Smith U.S. Pat. No. 2,838,364 discloses that cellulosic fibers may be spun in a manner to produce filaments of hollow cross section through a spinneret having a plurality of counterbores each in the shape of a sector of a circle.

Imobersteg et al. U.S. Pat. No. 3,405,424 discloses a spinneret for manufacturing hollow synthetic fibers from counterbore groups having at least two laterally opposing star-shaped capillaries. X and Y star shapes are disclosed. Sometimes high pressures on the upstream side of the spinneret plate forces the legs of the star-shaped capillary apart.

Shemdin, U.S. Pat. No. 3,652,753 and Shemdin U.S. Pat. No. 3,860,679, describe a formula for predicting the appropriate capillary shape to eliminate the phenomenon of kneeing. Kneeing is defined as "when the line of flow of the filament is bent out of the vertical back toward the spinneret face at an angle with respect to the perpendicular to the spinneret face." Kneeing may be so severe that the line of flow actually bends back and touches the spinneret face or it may be only sufficient to cause two or more adjacent filaments to touch and coalesce. The capillaries are generally T-shaped.

Paliyenko et al. U.S. Pat. No. 3,734,993 teaches that the effect of kneeing in T-shaped capillaries is reduced if the stems of the T's are arranged such that each stem extends perpendicularly outward (relative to the spinneret die plate) from the cross bar.

Phillips U.S. Pat. No. 3,981,948 discloses that kneeing may be used to coalesce individual molten streams. Phillips extrudes individual molten streams through non-round orifices which are dimensioned according to a specified formula. The formula assures that the coordinates of the centroid of the square of the velocity profile of the extruding material in the plane perpendicular to the axis of the capillary and the coordinates of the centroid of velocity profile of the extruding material in the plane perpendicular to the axis of the capillary are non-coincident.

Conversely, Phillips U.S. Pat. No. 4,142,850, describes that certain non-round spinneret capillaries eliminate the kneeing of extruding filaments. The patent applies a formula for configuring the orifices by using the centroid of the square of the velocity profile of the extruding material and the centroid of the velocity profile of the extruding material. When these two parameters are co-incident at each capillary exit, the extruding filaments should not knee.

In addition to the foregoing, there are various patents showing that rounded capillaries can be spaced or configured such that their respective extruded streams will merge prior to solidification. Hodge U.S. Pat. No. 3,924,988 shows a spinneret provided with a group of capillaries each defining an arcuate segment and having inwardly tapered enlargements. The particular structure causes a velocity differential to occur in the polymer flow that favors coalescence at the tapered portions to form a single round or rounded hollow filament.

Gintis et al. U.S. Pat. No. 4,407,889 shows a method for preparing splittable hollow filaments. These filaments have longitudinal grooves and ridges that are readily split along the grooves. The spinneret used to produce these fibers includes a group of capillaries arranged so hat the molten streams issuing therefrom each bulge as they leave the face of the spinneret, causing the streams to coalesce and form the desired hollow filament.

In Yu et al. U.S. Pat. No. 4,325,765, high denier non-round filaments are produced by extruding a molten polymer (polyester) through adjacent orifices which are spaced such that the extruded streams merge prior to solidification. This patent addresses the stated problem that markedly non-round cross-sectional filaments having deniers of at least 10 could not be successfully melt spun from polyester polymers at high speeds using the techniques known at that time.

In contrast to patents showing the goal of melt stream coalescence, there are also patents directed to spinnerets designed to allow filaments to be extruded in high density without coalescence. One such patent is Pfeiffer et al. U.S. Pat. No. 4,318,680 which shows a spinneret plate having multiple capillaries per counter-bore that effectively melt spins fusion melts of acrylonitrile polymer and water without coalescence. The patent is concerned with round cross-sections.

There remains a need for a manner of producing fibers with non-round cross-sections in high density and without coalescence. This goal has, to Applicant's knowledge, been elusive.

SUMMARY OF THE INVENTION

Accordingly, the present invention includes a spinneret plate defining at least one counterbore and within the counterbore at least one non-round curved capillary having a plurality of extending tips, at least two of the extending tips having a different radius of curvature.

An object of the present invention is to provide an improved spinneret plate for extruding molten polymers into fibers.

A further object of this invention is to provide an improved process for extruding molten polymers.

Related objects and advantages will be apparent to one ordinarily skilled in the relevant art after reviewing the following description.

DETAILED DESCRIPTION OF THE PREFERRED EMBODIMENTS

For the purpose of promoting an understanding of the principles of the invention, reference will now be made to specific embodiments of the invention and specific language which will be used to describe the same. It will nevertheless be understood that no limitation of the scope of the invention is thereby intended, such alterations and further modifications, and such further applications of the principles of the invention as discussed are contemplated as would normally occur to one skilled in the art to which the invention relates.

Figure 1:
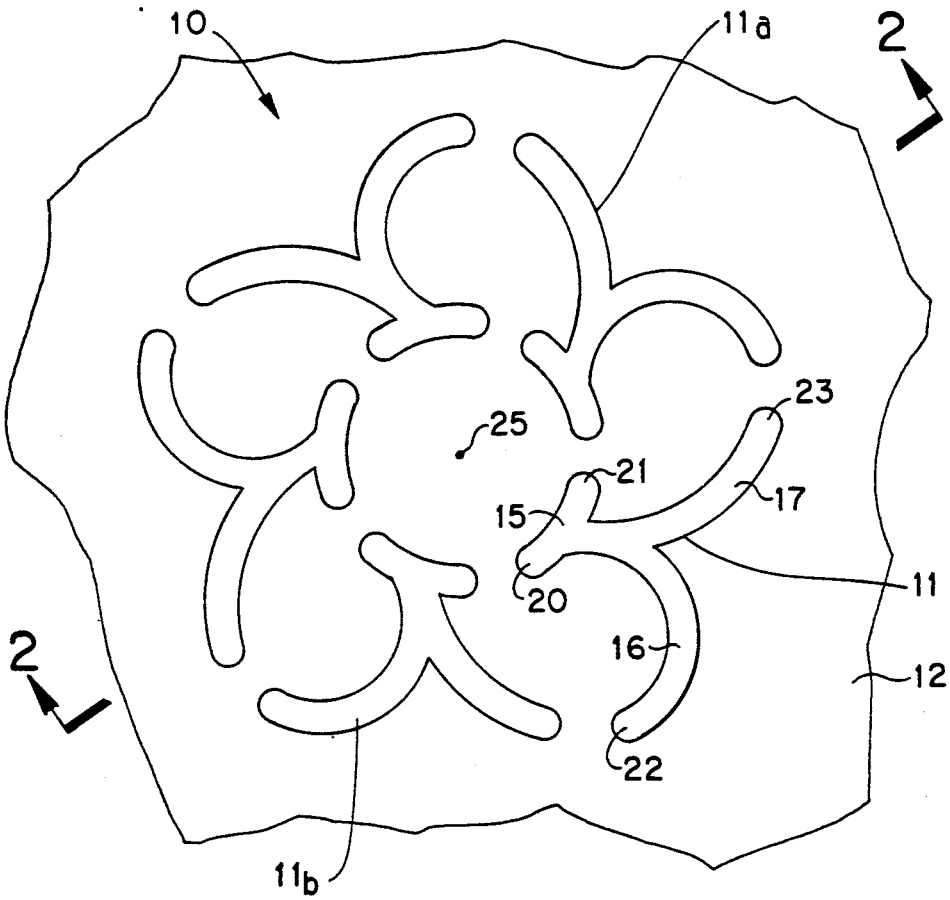
FIG. 1 is a portion of a spinneret face showing one cluster of capillaries according to the present invention.

In a first embodiment of the present invention, a spinneret plate allows high density spinning of non-round fiber from a single counterbore. FIG. 1 shows a single cluster 10 of non-round capillaries 11 as they appear from the downstream side of spinneret plate 12. The capillaries shown in FIG. 1 are exemplary of capillaries useful in the spinneret plate of the present invention. Each capillary 11 has three legs 15, 16 and 17. In FIG. 1 these legs are arranged so that four extending tips 20, 21, 22 and 23 are present.

Figure 2:
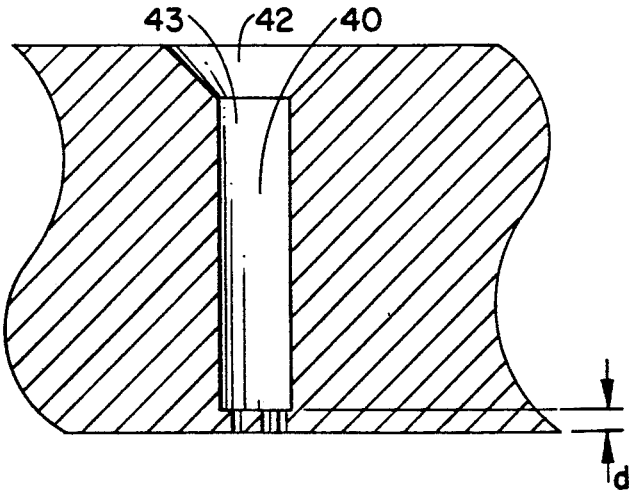
FIG. 2 is a cross-section taken along line 2—2 of FIG. 1.

Furthermore, as illustrated in FIG. 1, each leg is curved to define an arc. It will be understood, however, that it is not essential that every leg of the capillary is curved. For example, leg 15 might be linear. Returning to what is illustrated in FIG. 1, each of the arcs defined by the respective legs has a different origin. It will be understood that the term "origin" as used herein with reference to an arc, refers to the origin of the circle of which the arc is a segment. For example, the origin of the arc defined by leg 15 is near center 25 of cluster 10. Center 25 approximates the longitudinal axis of the counterbore (FIG. 2). The origin of the arc defined by leg 16 is between leg 16 and the closest edge of the next adjacent capillary. The origin of the arc defined by leg 17 is beyond the closest edge of the capillary next adjacent to that leg.

As shown in FIG. 1, in addition to having different origins, the arcs also define different radii of curvature. For example, the radius of the arc defined by leg 17 is the longest. The radius of the arc defined by leg 15 is the next longest and the radius of the arc defined by leg 16 is the shortest. Furthermore, according to the depiction in FIG. 1, the origin of each arc defined by a capillary has a unique distance from the center (25) (or longitudinal axis) of the counterbore.

Each capillary is preferably about 0.1 mm from its nearest neighbor. Likewise, each cluster 10 is preferably about 10 mm from its nearest neighbor, measured center to center. The dimensions of the spinneret plate itself are without restriction. The plate may be fashioned to a size suitable for the process conditions and the filaments extruded.

There are, of course, many considerations when selecting the dimensions of the spinneret plate, counterbores and capillaries. Intercapillary distance depends upon polymer thruput, polymer temperature, polymer flow properties (like melt viscosity and melt elasticity), quenching conditions, the size and shape of the capillary legs (15, 16 and 17) and the mechanical strength of the spinneret design. Concerns in choosing the dimension include obtaining the desired cross section and maintaining the mechanical integrity of the spinneret, i.e., the capillary cluster. Referring to FIG. 1, the cluster of capillaries can be thought of as a disk supported as the five places (ribs) where tips 22 and 23 are closest to their nearest neighbors. The ribs must be able to support the entire orifice disk against the upstream polymer pressure. If the ribs are unable to support the pressure, the disk may rupture. The orifice depth (in the flow direction) and overall dimensions are preferably selected based upon the permissible back pressure. If the rib width is too narrow, the disk could rupture. If the rib is too wide (keeping other dimensions constant), it begins to affect the leg configuration and the polymer stream no longer bends. By increasing the dimensions of the orifice proportionately, the rib can be made much wider.

It is notable that, in addition, experience suggests that when the ribs have a width of about 0.10 to 0.11 mm, the polymer streams are expected to merge. This expectation is surprisingly not borne out in the present invention.

FIG. 2 is taken along line 2—2 of FIG. 1 and illustrates a cross-section through spinneret plate 12 showing the relationship between counterbore 40 and capillaries 11. It is preferable in constructing the counterbore that entrance cone 42 is two to three times the diameter of back hole 43. Entrance cone 42 is shown with a 90° full angle. In the illustration, back hole 43 has a diameter about 1 mm larger than the diameter of the orifice cluster. Of course, the length of back hole 43 depends upon the spinneret thickness. In the presently preferred embodiment, the back hole is approximately 12 mm. Capillary depth (d) is selected to withstand back pressure (as discussed above). In the presently preferred embodiment, this depth is about 0.7 mm.

Turning to a second embodiment of present invention. A method for melt spinning filaments from molten polymers involves extruding molten polymer through a single counterbore which counterbore includes a plurality of separate capillaries. Each capillary produces a non-coalescing independent polymer stream which hardens into an independent non-round filament. A capillary cluster 10 such as that shown in FIG. 1 above, is useful in this method.

This method produces fine filaments of lobal cross-sections. For the present purposes, filaments having an undrawn denier between about 3 to about 12 are considered fine.

To practice the present process, a spinneret plate 12 (see FIG. 1) may be used in any known melt spinning process.

Figure 3:
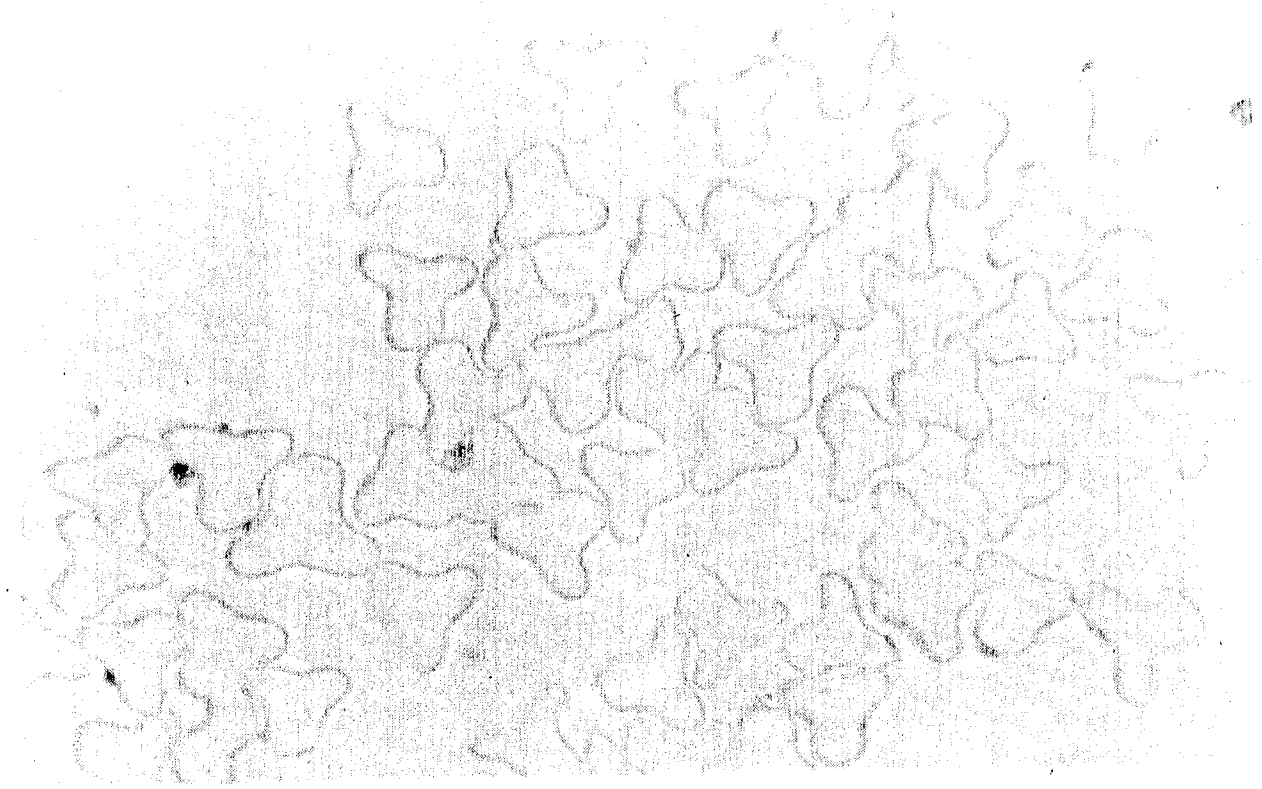
FIG. 3 is a photograph representing the filaments produced by Example 1 below.

The present invention results in a lobal filament cross-section. This filament is extruded by using spinneret plate 12 in the method of the present invention. FIG. 3 illustrates the unique melt spun fiber cross-section that is achieved by extruding molten polymer through the spinneret of the first embodiment (see FIG. 1). The trilobal fiber 30 generally has one lobe which is thicker (or fatter) than the other two. The other two lobes are approximately the same size.

As applies to all embodiments, a conventional melt spinning process can be used. The following Example illustrates one such conventional process. A conventional process may be for polyester fibers or polyamide fibers. Other melt-spinnable thermoplastic fibers may also be used. It is also contemplated that other processes and applications will be enhanced when the principles discussed herein are applied.

The invention will now be described by referring to the following detailed example. This example is set forth by way of illustration and is not intended to be limiting in scope.

EXAMPLE 1

Nylon 6 chip having a nominal relative viscosity of 2.7 is fed from a hopper to a screw extruder. The extruder melts and pressurizes the polymer to 1800 psi at a temperature of 270° C. A Dowtherm ® heated distribution line routes the polymer to a spin block while maintaining the polymer temperature. At the spin block, also Dowtherm ®heated, the polymer stream is split into four (4) smaller streams each supplying a separate metering gear pump. The four (4) metered streams, each having a flow rate of 68 grams/min, pass back through the spin block and into the polymer entrance of the four (4) spin packs. The spin pack consists of a filter cavity, sintered metal filtration, spinneret plate, gasket seals and a housing. The spin pack is bolted against the spin block using a seal between the contacting surfaces. The spin pack is located within a heated cavity having only its downstream face exposed. Within the spin pack, the polymer passes through sintered metal filtration before exiting through the spinneret. The spinneret has 14 counterbores as shown in FIG. 2 through which the polymer exits.

The multilobal fibers emerging from the face of the spinneret and having the general shape of the fibers shown in FIG. 3, are quenched within the quench cabinet by transverse air flow having a velocity of 120 ft/min and a temperature of 12° C. The filaments pass downward through the quench chimney to the takeup unit. At the takeup unit, an aqueous finish is applied to the filaments by a finish kiss roll. The filaments, now merged into a multifilament yarn, pass over a pair of godets driven at 865 m/min arranged generally in an "S" shaped configuration. The yarns are then wound upon a tube at the winder.

The resulting yarn has an undrawn denier of approximately 726, with an elongation of 351%.

What is claimed is:

1. A spinneret plate defining at least one counterbore having a longitudinal axis and within said counterbore at least one asymmetrical non-round curved capillary having a plurality of extending tips, wherein for any one capillary, at least two of said extending tips have a different radius of curvature and wherein at least two of said tips converge to form a stem which points generally toward said longitudinal axis.

2. The spinneret plate of claim 1 wherein, for any one capillary, said extending tips define a plurality of intersecting arcs, each of said arcs having a different origin.

3. The spinneret plate of claim 2 wherein each of said capillaries defines three intersecting arcs.

4. The spinneret plate of claim 1 wherein each said counterbore includes a plurality of said capillaries.

5. The spinneret plate of claim 4 wherein each said counterbore includes five capillaries.

6. The spinneret plate of claim 4 wherein said capillaries are about 0.1 mm apart as measured from the nearest tips.

7. The spinneret plate of claim 1 wherein said plate includes a plurality of counterbores.

8. A spinneret plate defining at least one counterbore having a longitudinal axis and within said counterbore at least one asymmetrical non-round curved capillary having a plurality of extending tips defining arcs, wherein the distance between the axis of the counterbore and the origin of the arc defined by each tip is not the same for any two tips and wherein at least two of said tips converge to form a stem which points generally toward the longitudinal axis.

9. The spinneret plate of claim 8 wherein each of said capillaries defines three intersecting arcs.

10. The spinneret plate of claim 8 wherein each said counterbore includes a plurality of said capillaries.

11. The spinneret plate of claim 10 wherein each said counterbore includes five capillaries.

12. The spinneret plate of claim 10 wherein said capillaries are about 0.1 mm apart as measured from the nearest tips.

13. The spinneret plate of claim 8 wherein said plate includes a plurality of counterbores.

* * * * *